US008066823B2

(12) United States Patent
Ross

(10) Patent No.: US 8,066,823 B2
(45) Date of Patent: Nov. 29, 2011

(54) DEVICE FOR CLEANING OF ENCLOSED SPACES

(75) Inventor: Martin Ross, Sjobo (SE)

(73) Assignee: Scanjet Marine AB, Sjobo (SE)

( * ) Notice: Subject to any disclaimer, the term of this patent is extended or adjusted under 35 U.S.C. 154(b) by 419 days.

(21) Appl. No.: 12/514,880

(22) PCT Filed: Nov. 14, 2007

(86) PCT No.: PCT/SE2007/001003
§ 371 (c)(1),
(2), (4) Date: May 14, 2009

(87) PCT Pub. No.: WO2008/060223
PCT Pub. Date: May 22, 2008

(65) Prior Publication Data

US 2010/0043849 A1 Feb. 25, 2010

(30) Foreign Application Priority Data

Nov. 16, 2006 (SE) ..... 0602447

(51) Int. Cl.
*B08B 3/02* (2006.01)

(52) U.S. Cl. ..... 134/167 R; 134/169 R; 134/181; 239/240

(58) Field of Classification Search ..... 134/166 R, 134/167 R, 168 R, 169 R, 180, 181; 239/240
See application file for complete search history.

(56) References Cited

U.S. PATENT DOCUMENTS 2,766,065 A * 10/1956 Joyslen ..... 239/227
3,416,732 A * 12/1968 Reiter ..... 239/227
3,464,632 A * 9/1969 Bristow ..... 239/227
3,544,012 A 12/1970 McNally
3,584,790 A * 6/1971 Bonfield ..... 239/227
(Continued)

FOREIGN PATENT DOCUMENTS

DE 102004008859 A1 9/2005
(Continued)

OTHER PUBLICATIONS

European Search Report. Application No./Patent No. 07835023.6-2425 / 2091670 PCT/SE2007001003. Date of completion of the search Mar. 16, 2011.

(Continued)

*Primary Examiner* — Frankie L Stinson
(74) *Attorney, Agent, or Firm* — Mollborn Patents, Inc.; Frederik Mollborn

(57) ABSTRACT

Devices for cleaning of enclosed spaces by means of liquid sprayed out. The device comprises a housing with a stationary part to which the liquid is supplied and on which a rotatable part bearing a hub is mounted. The hub has at least one spray nozzle. An element suspends the hub in a bearing in the rotatable part. The rotatable part comprises a turbine driven by the liquid and having a planetary gear for turning the rotatable part and at least one nozzle so that the liquid sprayed out by at least one of the nozzles during rotation sweeps across the inside of the enclosed spaces. The stationary part comprises an upper ring gear in engagement with a lower ring gear on the hub, which two ring gears are surrounded by the housing. The turbine and the planetary gear are fitted in the rotatable part to achieve a compact device.

13 Claims, 4 Drawing Sheets

U.S. PATENT DOCUMENTS

| | | | | |
|---|---|---|---|---|
| 4,244,524 | A * | 1/1981 | Wellings | 239/227 |
| 5,333,630 | A | 8/1994 | Jepsen et al. | |
| 5,640,983 | A | 6/1997 | Sherman, Jr. et al. | |
| 6,460,553 | B1 * | 10/2002 | Owens et al. | 134/167 R |
| 6,561,199 | B2 * | 5/2003 | Gleeson et al. | 134/22.18 |
| 6,715,699 | B1 | 4/2004 | Greenberg et al. | |
| 2003/0145880 | A1 * | 8/2003 | Jepsen et al. | 134/167 R |

FOREIGN PATENT DOCUMENTS

| | | | |
|---|---|---|---|
| DE | 102004052794 | B3 | 10/2005 |
| DE | 102005038194 | B3 | 7/2006 |
| GB | 1079867 | A | 8/1967 |
| WO | WO 99/47271 | | 9/1999 |
| WO | WO 2006/048067 | A1 | 5/2006 |

OTHER PUBLICATIONS

Extract from "Instruction Manual Biojet 10". ScanJet Systems, Inc. Houston, TX. p. 7.

Extract from "Instruction Manual Biojet 10". ScanJet Systems, Inc. Houston, TX. pp. 14-18.

Extract from "Instruction Manual Toftejorg TJ20G". p. 8.

Extract from "Instruction Manual Toftejorg TJ20G". p. 14.

International Search Report and Written Opinion of the International Searching Authority; International Application No. PCT/SE2007/001003; Completed Jan. 4, 2008.

* cited by examiner

DEVICE FOR CLEANING OF ENCLOSED SPACES

CROSS-REFERENCE TO RELATED APPLICATIONS

This application is a national phase application of PCT Application No. PCT/SE2007/001003, filed on Nov. 14, 2007, titled "Device for cleaning of enclosed spaces," which in turn claims priority to Swedish Application No. 0602447-5, filed on Nov. 16, 2006. The subject matter of both of these applications is incorporated herein by reference for all purposes.

BACKGROUND

The present invention relates to a device for cleaning of enclosed spaces. U.S. Pat. No. 3,544,012 refers to a device for cleaning of enclosed spaces, e.g. the inside of a tank. During the cleaning of a tank, the device according to U.S. Pat. No. 3,544,012 is placed centrally in the tank. The problem with the device according to U.S. Pat. No. 3,544,012 is that it has at regular intervals to be raised up out of the tank for cleaning of the device itself. This is because it includes a number of parts where dirt and bacteria can accumulate, which parts are not washed clean by the device during operation.

SUMMARY

In general, in one aspect, the various embodiments provide a device for cleaning of enclosed spaces by means of liquid sprayed out. The device includes a housing with a stationary part to which the liquid is supplied and on which is mounted a rotatable part having a hub, which hub is provided with at least one spray nozzle and is suspended, via an element, in a bearing in the rotatable part. The rotatable part includes a turbine which is driven by the liquid and has a planetary gear for turning the rotatable part and at least one nozzle in such a way that the liquid sprayed out through at least one of the nozzles during rotation sweeps across the inside of the enclosed spaces. The stationary part includes an upper ring gear which is in engagement with a lower ring gear on the hub. The two ring gears are surrounded by the housing. The turbine and the planetary gear are fitted in the rotatable part.

Various implementations can include one or more of the following features. The turbine and the planetary gear can be placed in the rotatable part in such a way that the turbine and the planetary gear rotate about a centerline running centrally through the turbine and the planetary gear, which centerline can be placed horizontally. A turbine shaft can connect the turbine and the planetary gear with and after one another by the fact that the turbine shaft extends horizontally centrally through the turbine and planetary gear and the extent of the turbine shaft coincides with the centerline through the turbine and the planetary gear, whereby the centerline also extends centrally through the turbine shaft in its extent. The planetary gear can include first and second planet wheels which under the influence of the turbine shaft are caused to rotate so that the lower ring gear, which takes the form of an annular bevel gear, is caused to rotate about said centerline.

The lower ring gear can cooperate with the upper ring gear, which takes the form of an annular bevel gear and is connected to the stationary part, with the result that during rotation of the lower ring gear the cooperation between the ring gears causes the rotatable part to rotate in a motion about a vertical centerline which extends centrally through the device and which crosses at a right angle the horizontal centerline.

The hub can be suspended in the bearing via an element which forms part of the lower ring gear and which cooperates with the bearing, which bearing is annular and extends about the centerline. The hub can surround part of the turbine shaft and part or the whole of the turbine and that the hub and the turbine can rotate at different speeds relative to one another about the centerline. The hub can surround a number of means which are connected to the turbine, are caused to rotate about the centerline during rotation of the turbine and, during the rotation, sweep across the inside of the hub across inlets to passages leading to the nozzles on the outside of the hub so that the inlets are alternately closed and opened by the means sweeping across them, resulting in a pulsating liquid jet from the nozzles.

The hub can be connected to the lower ring gear by a first locking ring as a result of a number of releasable connecting elements being placed in cavities through the hub and the element, with which connecting elements the locking ring cooperates. The stationary part can be connected to the upper ring gear by a second locking ring as a result of the locking ring cooperating with a number of releasable connecting elements which are placed in cavities through walls of the stationary part and extend into at least one groove in the upper ring gear. Part of the liquid flow can extend in such a way that after the liquid has passed through the device it is led out through slits provided between the stationary part and the rotatable part and between the rotatable part and the hub. The slits can be oriented in such a way that the liquid flowing out sweeps across the external surfaces of the housing. A shield disposed on the hub can mask part of the slits and lead the liquid flowing out towards the shield away so that the liquid sweeps across the external surfaces of the housing.

Various embodiments can include one or more of the following advantages. The device is of compact configuration. Its compactness simplifies the transport of the device to a tank. Assembling the device is also simplified through not requiring a great deal of space for the fitting or replacement of parts. The device has only a small number of movable parts. The reduced number of movable parts in a device as compared with conventional cleaning devices reduces the risk of complications with regard to parts. This is because the parts which tend most often to fail in a device are the movable ones. The number of threaded elements is reduced as compared with conventional cleaning devices, which raises the hygiene standard in that not having threads reduces the possible sites liable to bacteria growth. The device is self-cleaning. This means that the device can be in spaces which are closed, sealed or difficult of access without having to remove it for cleaning.

Having both the planetary gear and the turbine situated in the rotatable part results in compactness of the device. Such a solution makes it possible to reduce the height of the housing as compared with conventional cleaning devices, since it means that the rotatable part need not be adapted to accommodate any component such as, for example, the planetary gear or the turbine. Only one component, the turbine shaft, influences the rotation of both the turbine and the constituent parts of the planetary gear. It takes less liquid for the device to clean a space, since the liquid jet is pulsating and discontinuous and therefore uses a smaller volume of liquid. An advantage of using locking rings is that the need to connect constituent parts of the device to one another by means of threads to cater for screwed or bolted connections can be eliminated. Threads are difficult to reach and it is difficult to guarantee that they do not contain bacteria or dirt. It is therefore desirable to have as few threads as possible to reduce the risk that bacteria and dirt might accumulate in the device. The fact that liquid can flow through the slits reduces the risk of bacteria and/or dirt accumulating at the transition between two parts which are movable relative to one another.

BRIEF DESCRIPTION OF THE DRAWINGS

The device according to various embodiments of the invention is described below in more detail with reference to the attached schematic drawings, which only show the parts necessary for understanding the invention.

DETAILED DESCRIPTION

Figure 1:
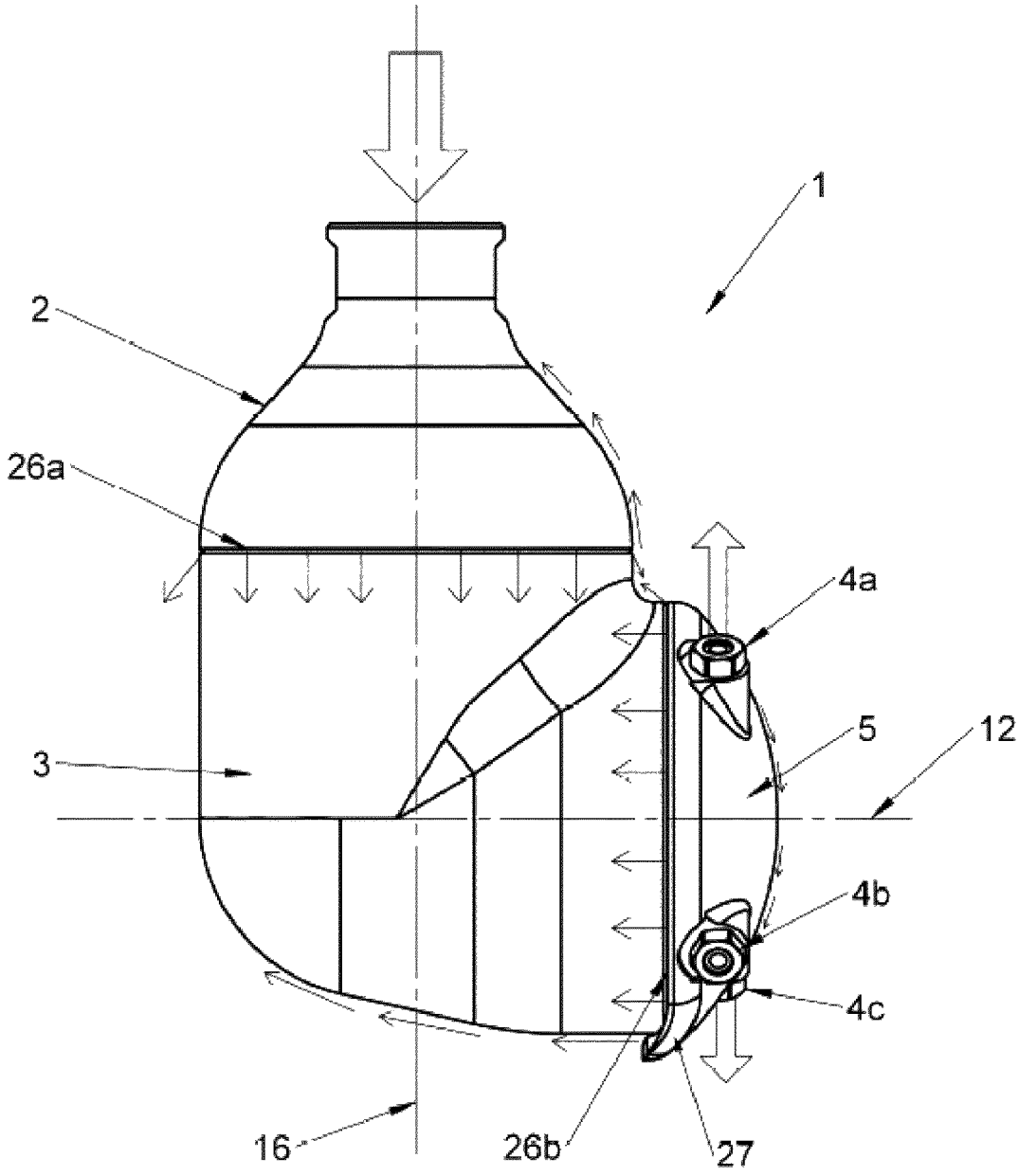
FIG. 1 depicts a device during operation as observed from outside, with markings denoting liquid jets flowing out, in accordance with one embodiment.

FIG. 1 depicts a device as viewed from the outside, comprising a housing (1). The housing (1) comprises a stationary part (2), a rotatable part (3), a number of spray nozzles (4*a-c*), and a hub (5) to which the nozzles (4*a-c*) are connected. The stationary part (2) and the rotatable part (3) can move relative to one another by the rotatable part (3) rotating about a vertical centerline (16) through the device. The rotatable part (3) and the hub (5) with the nozzles (4*a-c*) can move relative to one another by the hub (5) rotating about a centerline (12) which extends through the rotatable part (3) and the hub (5). This centerline (12) may preferably be horizontal.

Externally the housing is free from protruding or recessed fastening elements, fastening devices or other elements that might constitute sites for accumulation of dirt and bacteria.

FIG. 1 shows how flows of liquid move across the housing. Between the parts which are movable relative to one another there are slits (26*a-b*) whereby liquid can flow at transitions between the parts. This makes it possible for the device to be self-cleaning during use.

Figure 2:
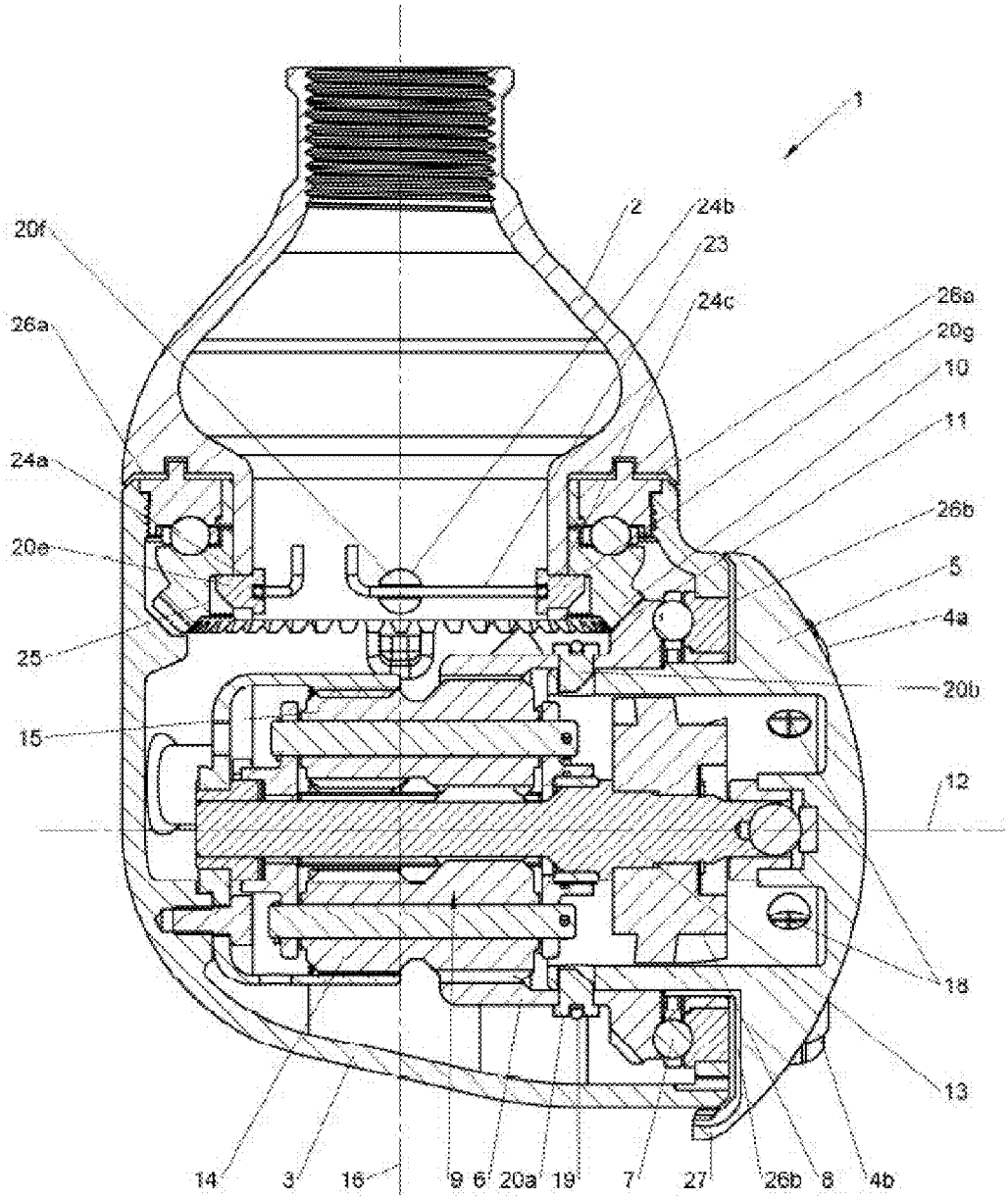
FIG. 2 depicts components of the device via a section through the device, in accordance with one embodiment.

FIG. 2 shows in section through the device some of the components situated inside the housing (1). The majority of the components are situated in the rotatable part (3). The rotatable part (3) comprises, as viewed from the right in FIG. 2 where the hub (5) is situated, a bearing (7), an element (6), a turbine (8), a planetary gear (9), a lower ring gear (11) and a turbine shaft (13). The turbine (8) and the planetary gear (9) have running through them the turbine shaft (13) which connects the turbine (8) and planetary gear (9) to one another so that there can be cooperation between the three.

The turbine shaft (13) extends centrally through both the turbine (8) and the planetary gear (9) in the extent of the turbine shaft (13). The extent coincides with a notional centerline (12) which in a corresponding manner extends through the turbine (8) and the planetary gear (9).

One end of the turbine shaft (13) is associated with an inside of the hub via a precision ball placed between the end and a centrally situated point on the inside of the hub (5). The hub (5) rotates about this central point. The central point on the hub (5) has the notional centerline (12) running through it. The turbine (8) is placed between the central point and the planetary gear (9).

The hub (5) comprises an outer portion and an inner portion. The outer portion comprises spray nozzles (4*a-d*) (4*c-d*) are not visible in FIG. 2). The number of spray nozzles (4*a-d*) can be varied from outside according to user requirements. The inner portion comprises a tubular section extending from the inside of the hub (5) towards the vertical centerline (16). The tubular section extends in such a way that it surrounds the turbine (8) but not the planetary gear (9). The tubular section of the hub (5) cooperates with the planetary gear (9) via the element (6). The element (6) is partly tubular. The element (6) has its one end surrounding part of the tubular section of the hub (5), and the other end surrounding part of the planetary gear (9). At the end which surrounds the planetary gear, the element (6) has internal teeth which cooperate with first and second planet wheels (14, 15) of the planetary gear (9).

The element (6) is connected to the hub by a number of releasable connecting elements (20*a-d*) (20*c-d* are not visible in FIG. 2) which cooperate with a first locking ring (19). The connecting elements (20*a-d*) extend through the element (6) via a hole in the element (6) and into hole recesses in the tubular section of the hub (5). The size of the hole recesses in the tubular section of the hub (5) is such that the connecting elements (20*a-d*) cannot entirely pass through them. The holes and the hole recesses are so positioned that they are situated over one another, whereby the connecting elements (20*a-d*) thus each extend through the respective hole and partly into the respective hole recess. When the connecting elements (20*a-d*) have been placed through the respective holes and hole recesses, the first locking ring (19) is placed on the connecting elements (20*a-d*) so that their positions become fixed. The connecting elements (20*a-d*) being fixed means that the element (6) and the tubular section of the hub (5) also become releasably connected and fixed to one another.

A lower ring gear (11) in the form of an annular bevel gear extends round an outside of the element (6) on the half of the element (6) which is nearest to the hub (5). This ring gear is in engagement with an upper ring gear (10) situated on and releasably connected to the stationary part (2). Like the lower ring gear (11), the upper ring gear (10) takes the form of an annular bevel gear.

A bearing (7) extends round the tubular section of the hub (5) and cooperates with the element (6).

A second locking ring (23) connects the stationary part (2) to the rotatable part (3) via a number of releasable connecting elements (20*e-h*) (20*h* is not visible in FIG. 2) placed in a manner corresponding to that of the connection between the element (6) and the tubular section of the hub (5). The stationary part (2) has a lower portion which, when the stationary part (2) and the rotatable part (3) are brought together, extends partly downwards into the rotatable part (3) so that the portion of the stationary part (2) is partly surrounded by the rotatable part (3). In order to connect the stationary part (2) releasably to the rotatable part (3), connecting elements (20*e-h*) are placed through holes (24*a-d*) (24*d* is not visible in FIG. 2) in the lower portion of the stationary part (2). The upper ring gear (10) extends on the outside of the holes (24*a-d*) and round the outside of the portion. The ring gear (10) comprises a groove (25) which extends in a surface facing towards the vertical centerline (16) and which extends through the device. The groove (25) accommodates the connecting elements (20*e-h*) which extend through the holes (24*a-d*) in the lower portion of the stationary part (2). The upper ring gear (10) is fixed in the rotatable part (3) by being situated between the lower ring gear (11) and an upper horizontal bearing placed on top of the upper ring gear (10). This upper horizontal bearing is connected to, and held in place relative to, the rotatable part (3) by a screwed connection cooperating with an upper edge region on the rotatable part (3), which edge region adjoins the stationary part (2). The fact that the connecting elements (20*e-h*) extend not only through the holes (24*a-d*) in the stationary part (2) but also into the groove (25) in the upper ring gear (10) means that the stationary part (2) is connected to the rotatable part (3). The second locking ring (23) functions in such a way that it abuts against the respective connecting elements (20*e-h*) and exerts a force directed outwards from the vertical centerline (16). The connecting elements (20*e-h*) are thus pressed between the stationary part (2) and the rotatable part (3) into the groove (25) in the upper ring gear (10), resulting in a releasable connection between the stationary part (2) and the rotatable part (3).

Slits (26*a-b*) are disposed at transitions between respective movable parts of the housing (1). The slits (26*a-b*) serve as passages for liquid. Their configuration is such that they direct the liquid in such a way that after passing through the slits (26*a-b*) it proceeds along the outside of the housing (1). The hub (5) comprises a shield (27) which masks part of the slits (26) and leads the liquid which flows out towards the shield (27) away so that the liquid sweeps across the external sides of the housing (1). These slits (26*a-b*) and shield (27) result in the whole outside of the housing (1) being swept across by liquid during operation.

Figure 3:
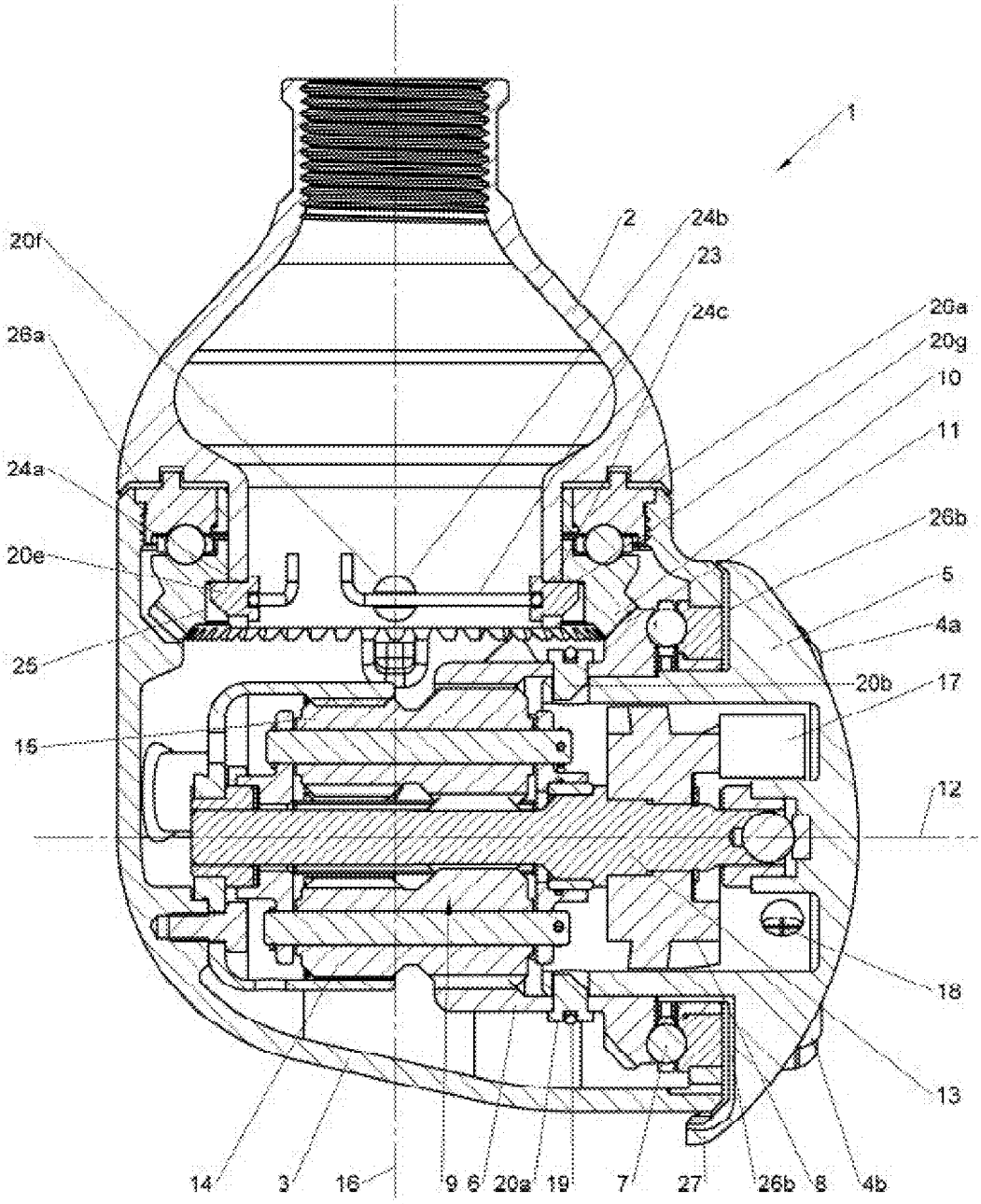
FIG. 3 depicts a variant of the device depicted in FIG. 2, in accordance with one embodiment.
Figure 4:
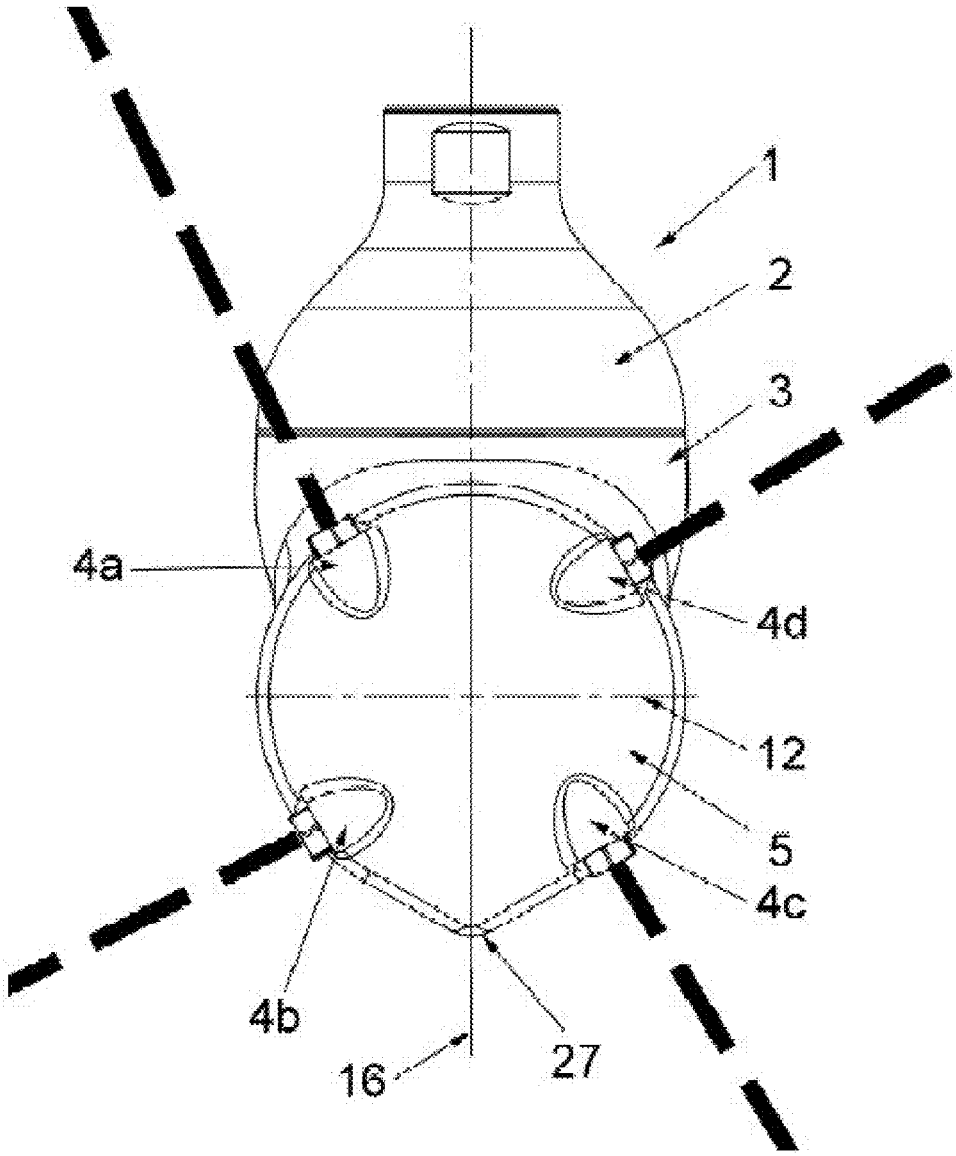
FIG. 4 depicts the device with a pulse-like liquid jet emerging from nozzles, in accordance with one embodiment.

FIG. 3 depicts a further embodiment of the invention where a number of means (17) are connected to the turbine (8) within the tubular section of the hub (5). The configuration of the means (17) is such that during rotation with the turbine (8) about the centerline (12) they sweep across inlets (18) on the inside of the hub (5). These inlets (18) lead liquid out to the nozzles (4*a-d*) (4*c-d* are not visible in FIG. 3) on the outside of the hub (5), which liquid leaving the nozzles (4*a-d*) hits the inside of the tank in order to clean it. When the means (17) are caused to rotate about the centerline (12), they sweep across the inlets (18) on the inside of the hub (5) so that the inlets (18) are alternately covered by the means (17) and alternately open. The result is a pulsating liquid jet from the nozzles (see FIG. 4). Using a pulsating liquid jet consumes less liquid during use of the device, since the liquid jet is not continuous.

During operation of the device, liquid enters the housing (1) via the stationary part (2) and proceeds to flow into the rotatable part (3). In the rotatable part (3), the liquid flows through and past the planetary gear (9) to the turbine (8) and out through the nozzles (4*a-d*) in the hub (5). The liquid causes the turbine (8) to rotate, with the result that the turbine (8) by means of the turbine shaft (13) causes the planetary gear (9) to rotate its constituent parts in the form of first and second planet wheels (14, 15). Through cooperation with the element (6), the planet wheels (14, 15) cause the hub (5) to rotate. The rotation of the element (6) contributes to rotation of the lower ring gear (11). The rotation of the ring gear (11) and its cooperation with the upper ring gear (10) therefore causes the rotatable part (3) to rotate about the vertical centerline (12) through the device. The fact that the hub with the nozzles and liquid spraying out is caused to rotate not only about the horizontal centerline (12) but also about the vertical centerline (16) means that the liquid spraying out reaches all the inside surfaces in an enclosed space.

The invention is not limited to the embodiments referred to above but may be varied and modified within the scopes of the claims set out below.

The invention claimed is:

1. A device for cleaning of enclosed spaces by means of liquid sprayed out, comprising a housing with a stationary part to which the liquid is supplied and on which is mounted a rotatable part comprising a hub, which hub is provided with at least one spray nozzle and is suspended, via an element, in a bearing in the rotatable part, which rotatable part comprises a turbine which is driven by the liquid and has a planetary gear for turning the rotatable part and at least one nozzle in such a way that the liquid sprayed out through at least one of the nozzles during rotation sweeps across the inside of the enclosed spaces, the stationary part comprising an upper ring gear which is in engagement with a lower ring gear on the hub, and the two ring gears being surrounded by the housing, wherein the turbine and the planetary gear are fitted in the rotatable part.

2. The device of claim 1, wherein the turbine and the planetary gear are placed in the rotatable part in such a way that said turbine and the planetary gear rotate about a centerline running centrally through the turbine and the planetary gear, which centerline may preferably be placed horizontally.

3. The device of claim 2, wherein a turbine shaft connects the turbine and the planetary gear with and after one another by the fact that the turbine shaft extends horizontally centrally through said turbine and planetary gear and the extent of the turbine shaft coincides with said centerline through the turbine and the planetary gear, whereby the centerline also extends centrally through the turbine shaft in its extent.

4. The device of claim 3, wherein the planetary gear comprises first and second planet wheels which under the influence of the turbine shaft are caused to rotate so that the lower ring gear, which takes the form of an annular bevel gear, is caused to rotate about said centerline.

5. The device of claim 3, wherein the hub surrounds part of the turbine shaft and part or the whole of the turbine and that the hub and the turbine rotate at different speeds relative to one another about the centerline.

6. The device of claim 2, wherein the lower ring gear cooperates with the upper ring gear, which takes the form of an annular bevel gear and is connected to the stationary part, with the result that during rotation of the lower ring gear the cooperation between said ring gears causes the rotatable part to rotate in a motion about a vertical centerline which extends centrally through the device and which crosses at a right angle said horizontal centerline.

7. The device of claim 2, wherein the hub is suspended in said bearing via an element which forms part of the lower ring gear and which cooperates with the bearing, which bearing is annular and extends about said centerline.

8. The device of claim 2, wherein the hub surrounds a number of means which are connected to the turbine, are caused to rotate about the centerline during rotation of the turbine and, during said rotation, sweep across the inside of the hub across inlets to passages leading to the nozzles on the outside of the hub so that the inlets are alternately closed and opened by the means sweeping across them, resulting in a pulsating liquid jet from the nozzles.

9. The device of claim 1, wherein the hub is connected to the lower ring gear by a first locking ring as a result of a number of releasable connecting elements being placed in cavities through the hub and the element, with which connecting elements the locking ring cooperates.

10. The device of claim 1, wherein the stationary part is connected to the upper ring gear by a second locking ring as a result of said locking ring cooperating with a number of releasable connecting elements which are placed in cavities through walls of the stationary part and extend into at least one groove in the upper ring gear.

11. The device of claim 1, wherein part of the liquid flow extends in such a way that after the liquid has passed through the device it is led out through slits provided between the stationary part and the rotatable part and between the rotatable part and the hub.

12. The device of claim 11, wherein the slits are oriented in such a way that the liquid flowing out sweeps across the external surfaces of the housing.

13. The device of claim 11, wherein a shield disposed on the hub masks part of the slits and leads the liquid flowing out towards the shield away so that the liquid sweeps across the external surfaces of the housing.

* * * * *